US009768560B2

(12) United States Patent
Yao et al.

(10) Patent No.: US 9,768,560 B2
(45) Date of Patent: Sep. 19, 2017

(54) ELECTRICAL CONNECTOR HAVING IMPROVED SHIELDING SHELL

(71) Applicant: FOXCONN INTERCONNECT TECHNOLOGY LIMITED, Grand Cayman (KY)

(72) Inventors: Tao Yao, Huaian (CN); Jing-Jie Guo, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/361,508

(22) Filed: Nov. 28, 2016

(65) Prior Publication Data

US 2017/0077654 A1 Mar. 16, 2017

Related U.S. Application Data

(63) Continuation-in-part of application No. 15/169,963, filed on Jun. 1, 2016.

(30) Foreign Application Priority Data

Jun. 1, 2015 (CN) ..... 2015 1 0291211
Nov. 27, 2015 (CN) ..... 2015 1 0840281

(51) Int. Cl.
*H01R 13/648* (2006.01)
*H01R 13/6594* (2011.01)
(Continued)

(52) U.S. Cl.
CPC ..... *H01R 13/6594* (2013.01); *H01R 12/724* (2013.01); *H01R 13/405* (2013.01);
(Continued)

(58) Field of Classification Search
CPC ..... H01R 13/6591; H01R 13/6594; H01R 13/405; H01R 13/501; H01R 12/724; H01R 43/0256; H01R 2107/00
(Continued)

(56) References Cited

U.S. PATENT DOCUMENTS 9,647,377 B1 * 5/2017 Peng ..... H01R 13/504
2015/0244111 A1 * 8/2015 Ju ..... H01R 13/6585 439/607.05
2015/0244118 A1 * 8/2015 Lin ..... H01R 24/60 439/357

FOREIGN PATENT DOCUMENTS

CN 202121098 U 1/2012
CN 202487853 U 10/2012
(Continued)

*Primary Examiner* — Khiem Nguyen
(74) *Attorney, Agent, or Firm* — Wei Te Chung; Ming Chieh Chang

(57) ABSTRACT

An electrical connector includes an insulative housing, a number of terminals disposed in the insulative housing, a metallic shielding plate, a shielding shell defining a mating cavity, and a metal shell. The insulative housing defines a base portion and a tongue portion extending forwardly from the base portion. The base portion includes a front side, a rear side opposite to the front side, at least one retaining slot located in the front side of the base portion. The shielding shell includes at least one front stopping portion protruding into the mating cavity and received in the retaining slot, the at least one front stopping portion includes a front surface located beyond the front side of the base portion to prevent damage the base portion when a mating connector inserting into the electrical connector.

20 Claims, 14 Drawing Sheets

(51) Int. Cl.

| | |
|---|---|
| ***H01R 12/72*** | (2011.01) |
| ***H01R 13/405*** | (2006.01) |
| ***H01R 13/50*** | (2006.01) |
| ***H01R 43/02*** | (2006.01) |
| *H01R 107/00* | (2006.01) |

(52) U.S. Cl.
CPC ..... *H01R 13/501* (2013.01); *H01R 43/0256* (2013.01); *H01R 2107/00* (2013.01)

(58) Field of Classification Search
USPC ..... 439/79, 607.35–607.4
See application file for complete search history.

(56) References Cited

FOREIGN PATENT DOCUMENTS

| | | | |
|---|---|---|---|
| CN | 203056161 | U | 7/2013 |
| CN | 103986000 | A | 8/2014 |
| CN | 204118373 | | 1/2015 |
| CN | 104377491 | | 2/2015 |
| CN | 104577417 | | 4/2015 |
| CN | 204315813 | U | 5/2015 |
| CN | 204516985 | | 7/2015 |
| CN | 104852204 | A | 8/2015 |
| TW | M358454 | U | 6/2009 |

* cited by examiner

ELECTRICAL CONNECTOR HAVING IMPROVED SHIELDING SHELL

BACKGROUND OF THE INVENTION

1. Field of the Invention

The present invention relates to an electrical connector, and more particularly to an electrical connector having an improved shielding shell. The instant application is a continuation-in-part of the copending application Ser. No. 15/169,963 filed on Jun. 1, 2016.

2. Description of Related Art

China Patent No. 204118373 discloses an electrical connector including an insulative housing, a plurality of terminals retained in the insulative housing, and a shell enclosing the insulative housing. The insulative housing includes a base portion, a front end of the base portion having a plurality of retaining slots. The shell includes a plurality of stopping portions retained in the retaining slot. Each stopping portion is wholly received in each retaining slot. When a mating connector is inserted into the electrical connector, it may damage the insulative housing of the electrical connector.

China Patent Application Publication No. 104377491 discloses an electrical connector including an insulative housing, a plurality of terminals retained in the insulative housing, and a shell enclosing the insulative housing. The insulative housing includes a base portion. A rear end of the shell includes a pair of stopping portions abutting against a rear side of the base portion. When a mating connector is inserted into the electrical connector, it may damage the insulative housing of the electrical connector.

Hence, an improved electrical connector is desired.

SUMMARY OF THE INVENTION

Accordingly, the object of the present invention is to provide an electrical connector comprising: an insulative housing defining a base portion and a tongue portion forwardly extending from the base portion in a front-to-back direction, the base portion defining a front side, a rear side opposite to the front side, and at least one retaining slot located in the front side; a plurality of terminals disposed in the insulative housing; a metallic shielding plate retained in the insulative housing; a shielding shell retaining with the insulative housing to form a mating cavity receiving the base portion, the shielding shell defining at least one front stopping portion protruding into the mating cavity and received in the at least one retaining slot; the at least one front stopping portion has a upstanding front surface, the front surface protruding out of the at least one retaining slot and located beyond the front side of the base portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
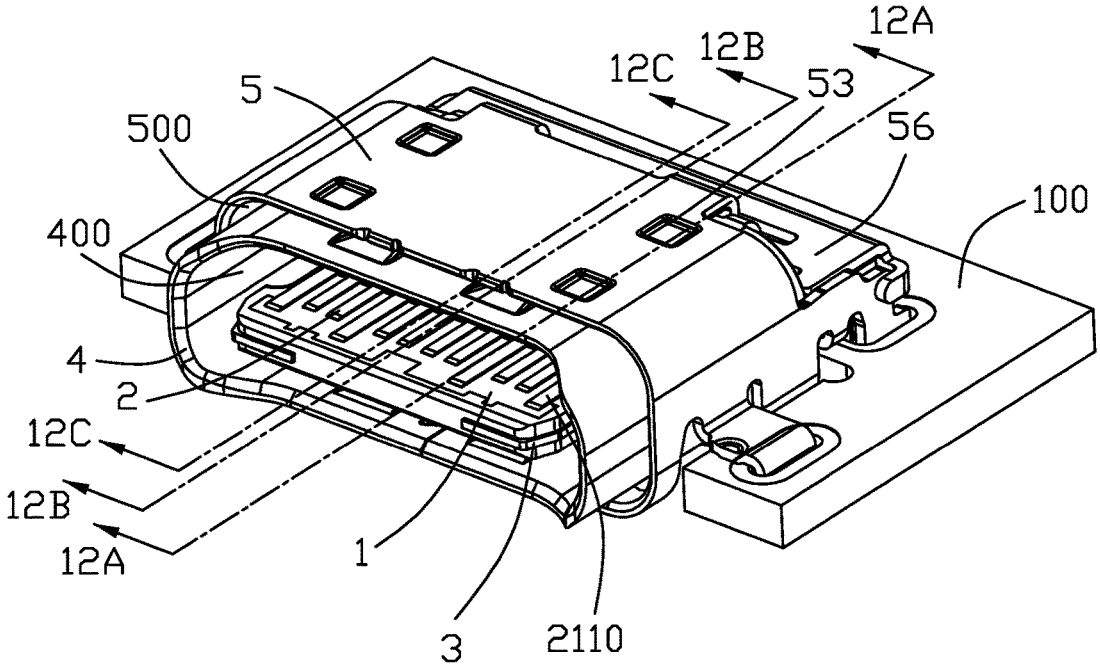
FIG. 1 is a perspective, assembled view of an electrical connector mounted upon a printed circuit board.
Figure 2:
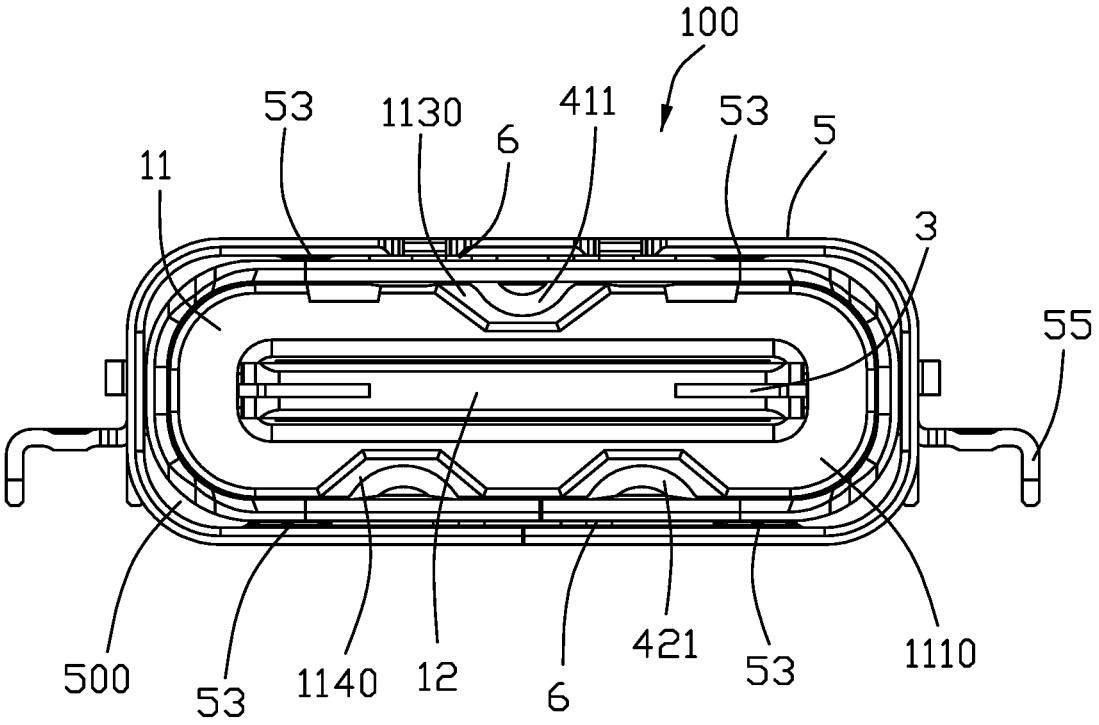
FIG. 2 is a perspective, front view of the electrical connector.

Reference will now be made in detail to the preferred embodiment of the present invention. FIGS. 1-12(C) show an electrical receptacle connector 100. For convenience, the electrical connector 100 defines a mating direction, a transverse direction perpendicular to the mating direction, and a vertical direction perpendicular to the mating direction and the transverse direction. The electrical connector 100 defines a mating port mated with a mating connector (not shown).

The electrical connector 100, mounted upon a printed circuit board 200 in a sunk manner, includes an insulative housing 1, a plurality of terminals 2 and a metallic shielding/grounding/retaining plate 3 retained in the insulative housing 1, a shielding shell 4 formed with a mating cavity to receive the insulative housing 1, two waterproofs 6 installing on the shielding shell 4, a sealer 7 sealing up a gap between the insulative housing 20 and the shielding shell 5, and a metal shell 5 attached to the shielding shell 4.

The insulative housing 1 includes a base portion 11 and a tongue portion 12 forwardly extending from the base portion 11. The base portion defines a front side 1110 and a rear side 1120 opposite to the front side 1110, the tongue portion 12 forwardly extending from the front side 1110 of the base portion 11. The base portion 11 includes a plurality of retaining slots located in an outer edge of the the front side 1110. The retaining slots include an upper retaining slots 1130 and a pair of bottom retaining slots 1140, the upper retaining slot 1130 is located at a middle position of an upper edge of the front side 1110, the pair of bottom retaining slots 1140 are located at a bottom edge of the front side 1110, the pair of bottom retaining slots 1140 are located on opposite sides of the upper retaining slot 1130.

The insulative housing 1 defines a first insulative body 13, a second insulative body 14 disposed in the vertical direction, and an insulator 15 accommodating the first insulative body 13 and the second insulative body 14. The base portion 11 includes a first base portion 131, a second base portion 141 and a third base portion 151. The tongue portion 12 includes a first tongue portion 132, a second tongue portion 142 and a third tongue portion 152. The first insulative body 13 includes the first base portion 131 and the first tongue portion 132, the first tongue portion 132 extending forwardly from the first base portion 131. The first base portion 131 forms a plurality of through holes 135 in alignment with tails of the second terminals 22 (illustrated later) for inspection of soldering state. The second insulative body 14 includes the second base portion 141 and the second tongue portion 142, the second tongue portion 142 extending forwardly from the second base portion 141. The insulator 15 includes the third base portion 151 and the third tongue portion 152, the third tongue portion 152 extending forwardly from the third base portion 151. The first base portion 131, the second base portion 141, and the third base portion 151 commonly form the base portion 11. The first tongue portion 132, the second tongue portion 142, and the third tongue portion commonly form the tongue portion 12.

Figure 10:
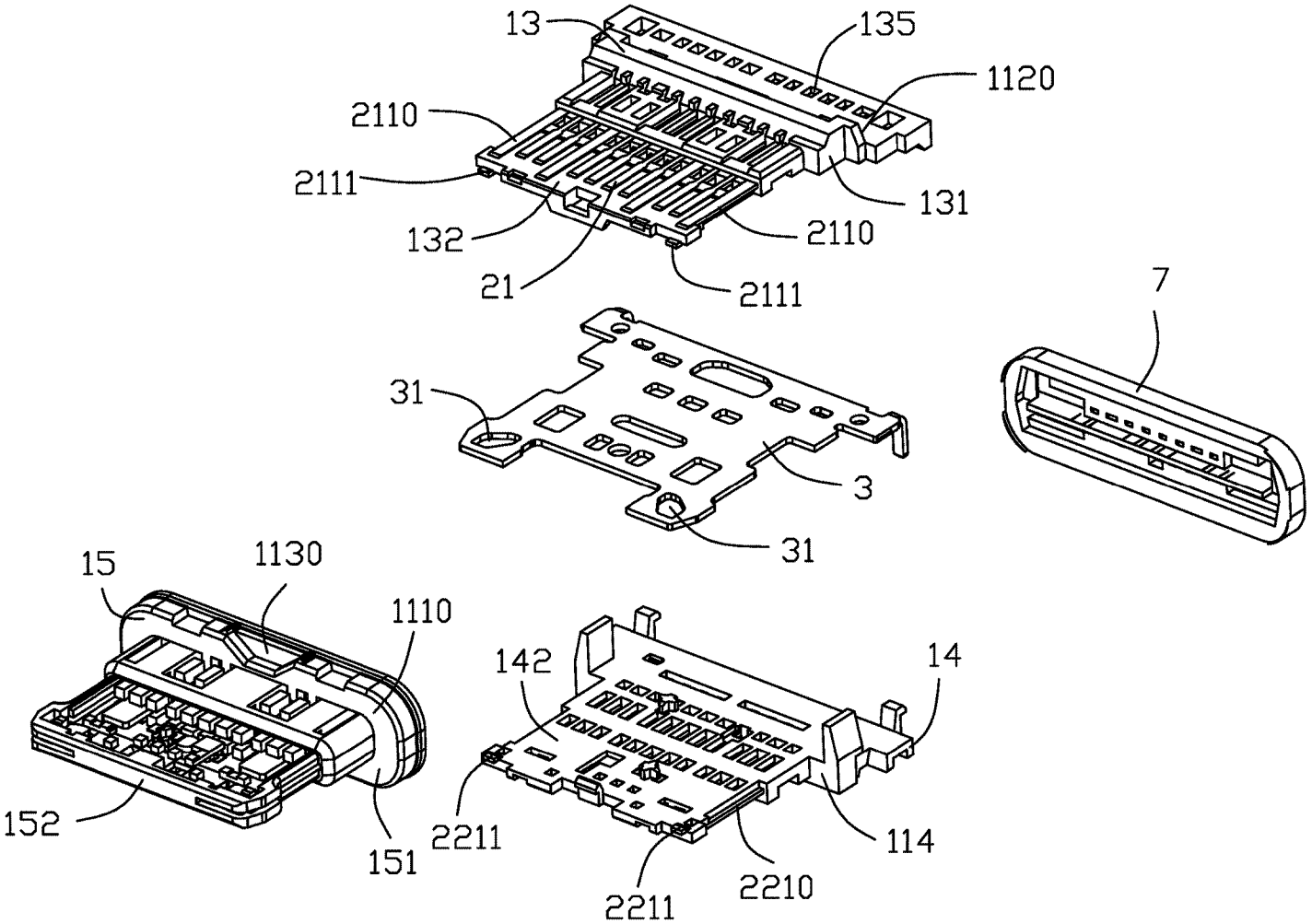
FIG. 10 is a perspective, exploded view of the electrical connector omitting a metal shell, a shielding shell and a pair of waterproof plates thereof.
Figure 11:
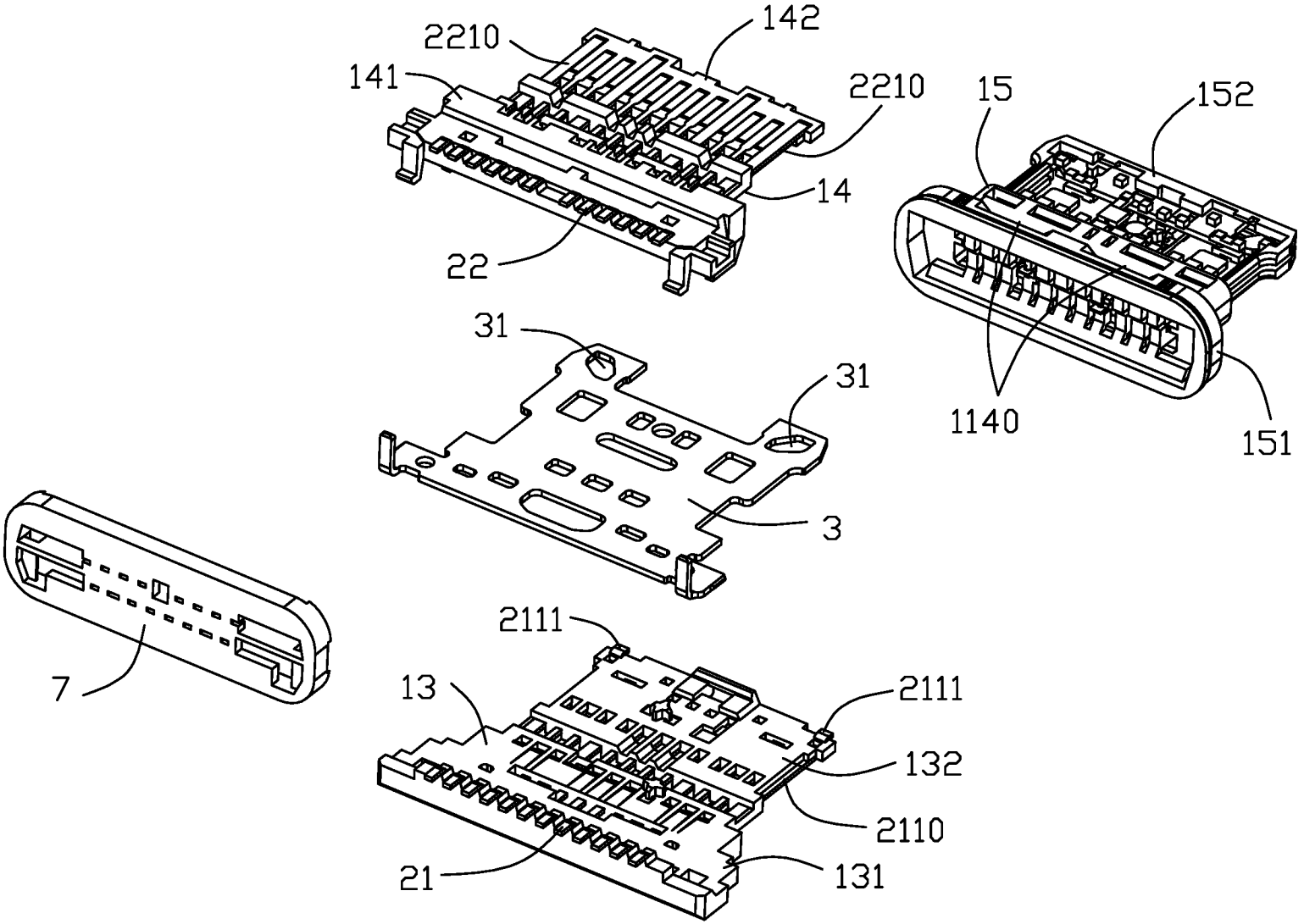
FIG. 11 is another exploded view of FIG. 10.

Referring to FIGS. 10-11, the front side 1110 of the base portion 11 is installed in the third base portion 151 of the insulator 15, the rear side 1120 of the base portion 11 is installed in the first base portion 131 of the first insulative body 13. In other words, the upper retaining slot 1130 and the pair of bottom retaining slots 1140 are located in the upper and bottom edge of front side 1110 of the third base portion 151 respectively.

Referring to FIGS. 1-12(C), the plurality of the terminals 2 include a plurality of first/upper terminals 21 and second/lower terminals 22. The first terminals 21 are retained in the first insulative body 13 and the second terminals 22 are retained in the second insulative body 14. The first terminals 21 and the second terminals 22 have the same number. Each first terminal 21 includes a contacting section exposed upon the upper surface of the tongue portion 12, and each second terminal 22 includes a contacting section exposed upon the lower surface of the tongue portion 12. The first contacts 21 and the second contacts 22 are positioned to have 180 degree symmetry such that the corresponding plug connector can be inserted and operatively coupled to the electrical connector 100 in either of two orientations. The first terminals 21 include a pair of first grounding terminals 2110 located on its opposite sides, each first grounding terminal 2110 includes a first abutting portion 2111 located at a bottom surface of the first tongue portion 132 and forwardly extending beyond a front face of the first tongue portion 132. The second terminals 22 include a pair of second grounding terminals 2210 located on its opposite sides, each second grounding terminal 2210 includes a second abutting portion 2211 located at an upper surface of the second tongue portion 142 and forwardly extending beyond a front face of the second tongue portion 142.

The metallic shielding plate 3 is made of metal material and a pair of holes 31 locating in a front end of the metallic shielding plate 3. The metallic shielding plate 3 is retained between the first insulative body 13 and the second insulative body 14.

The shielding shell 4 is a cannulate component and made of metal material. The shielding shell 4 retain with the insulative housing 1 and forming with a mating cavity 400 to receive the base portion 11. The shielding shell 4 includes an upper wall 41 and a bottom wall 42 opposite to the upper wall 41. The shielding shell 4 defines a plurality of front stopping portions and a pair of rear stopping portions 43 protruding into the mating cavity 400. The front stopping portions includes one upper stopping portion 411 formed on the upper wall 41 and a pair of bottom stopping portions 421 formed on the bottom wall 42 via stamping/splitting. The upper stopping portion 411 is retained in the upper retaining slot 1130, the pair of bottom stopping portions 421 are retained in the bottom retaining slots 1140. The upper stopping portion 411 and the pair of bottom stopping portions 421 are tearing formed with an arc-shaped section from the upper wall 41 and the bottom wall 42 respectively, and openings 45 formed at the tearing position on the upper wall 41 and the bottom wall 42 due to forming the corresponding upper stopping portion 411 and the bottom stopping portions 421. Each of the upper stopping portion 411 and the pair of bottom stopping portions 421 has an upstanding front/forward/abutment surface 44 forwardly beyond. The pair of rear stopping portion 43 formed on a rear end of the upper wall 41 and downwardly extending into the mating cavity 400. The shielding shell 4 further includes a plurality of curved protrusions 46 inwardly extending into the mating cavity 400 in the vertical direction for providing retention force during mating with the inserted plug connector. Notably, unlike the stopping portions 411, 421, the curved protrusions 46 do not result in the corresponding openings. The two waterproof layers or plates 6 are installed on an outer surface of the upper wall 41 and the bottom wall 42. The waterproof layers 6 are used for covering the openings 45 of the shielding shell 4. The sealer 7 sealing up the gap between the rear side 1120 of the base portion 11 and the rear end of the shielding shell 5.

The metal shell 5 is a cannulate component and made of metal material. The metal shell 5 retained with the shielding shell 4 and forming with a receiving cavity 500 to receive the shielding shell 4. The metal shell 5 includes an upper plate 51 and a bottom plate 52 opposite to the upper plate 51, the upper plate 51 and bottom plate 52 all include four protruding portions 53 downwardly protruding into the receiving cavity 500 and used for retaining with and/or soldering to the upper wall 41 and the bottom wall 42 of the shielding shell 4. In this embodiment, the metal shell 5 is equipped with mounting legs 55 for mounting to the printed circuit board 100 while the shielding shell 4 lacks the corresponding mounting legs. Also, the metal shell 5 further includes an extension 56 to cover the back side of the housing 1 for shielding while the shielding shell 4 lacks this shielding structure.

Referring to FIGS. 10-12(C), the method of making the electrical connector 100 includes the steps of: providing the first insulative body 13 retained with the first terminals 12, providing the second insulative body 14 retained with the second terminals 22, and providing the metallic shielding plate 3, assembling the metallic shielding plate 3 between the first insulative body 13 and the second insulative body 14 in a up-to-down direction, and then the first abutting portion 2111 the second abutting portion 2211 are received in the holes 31 of the metallic shielding plate 3 and connecting with each; providing the insulator 15 and the insulator 15 is integrally formed with the first insulative body 13, the second insulative body 14 and the shielding plate 3 via a second stage insert-molding process, and then a opposite side edge of the metallic shielding plate 3 are exposed to two opposite sides of the tongue portion 12 for electrically connecting with the mating connector (not shown); referring to FIGS. 2-12(C), providing the shielding shell 4 and assembling the shielding shell 4 to enclose the insulative housing 1, and then the upper stopping portion 411 and the pair of bottom stopping portions 421 are retained in the upper retaining slot 1130 and the bottom retaining slots 1140 respectively, the rear stopping portion 43 abuts against the rear side 1120 of the insulator 15 to prevent the insulative housing 1 move in a front-to-back direction, the upstanding front surface 44 of the upper stopping portion 411 and the bottom stopping portions 421 forwardly beyond the upper retaining slot 1130 and the bottom retaining slots 1140 respectively for preventing the mating connector (not shown) from damaging the insulative housing 1; providing two waterproof layers 6 and pasting them on the upper wall 41 and the bottom wall 42 of the shielding shell 4 to seal the opening 45; finally, providing the metal shell 5 and assembling the metal shell 5 to enclose the shielding shell 4, and then the four protruding portions 53 of the upper plate 51 and the four protruding portions 53 of the bottom plate 52 clamped on opposite side of the shielding shell 4. Preferably, the four protruding portions 53 of the upper plate 51 and the four protruding portions 53 all arranged in two rows, each row of the protruding portions 53 is located on an outer side of each waterproof layer 6 in a transverse direction perpendicular to the front-to-back direction. Preferably, the protruding portions 53 soldering with the shielding shell 4.

Figure 3:
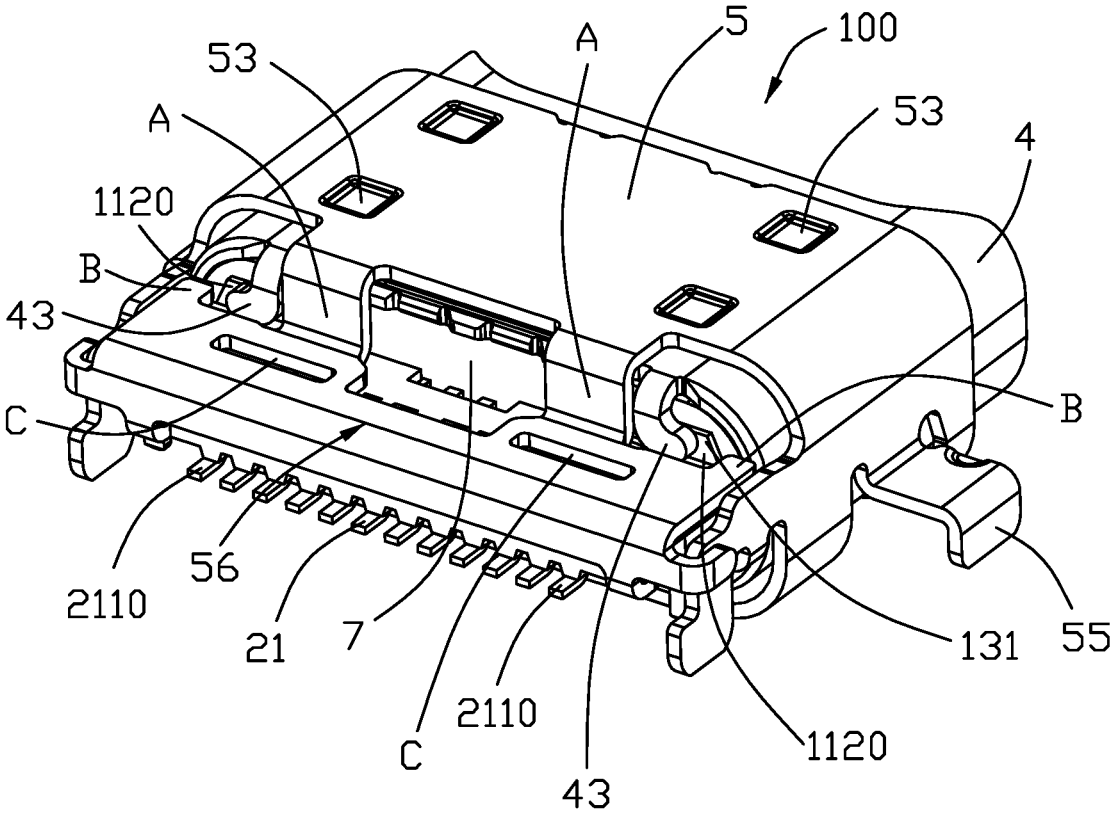
FIG. 3 is another view of the electrical connector of FIG. 2.
Figure 4:
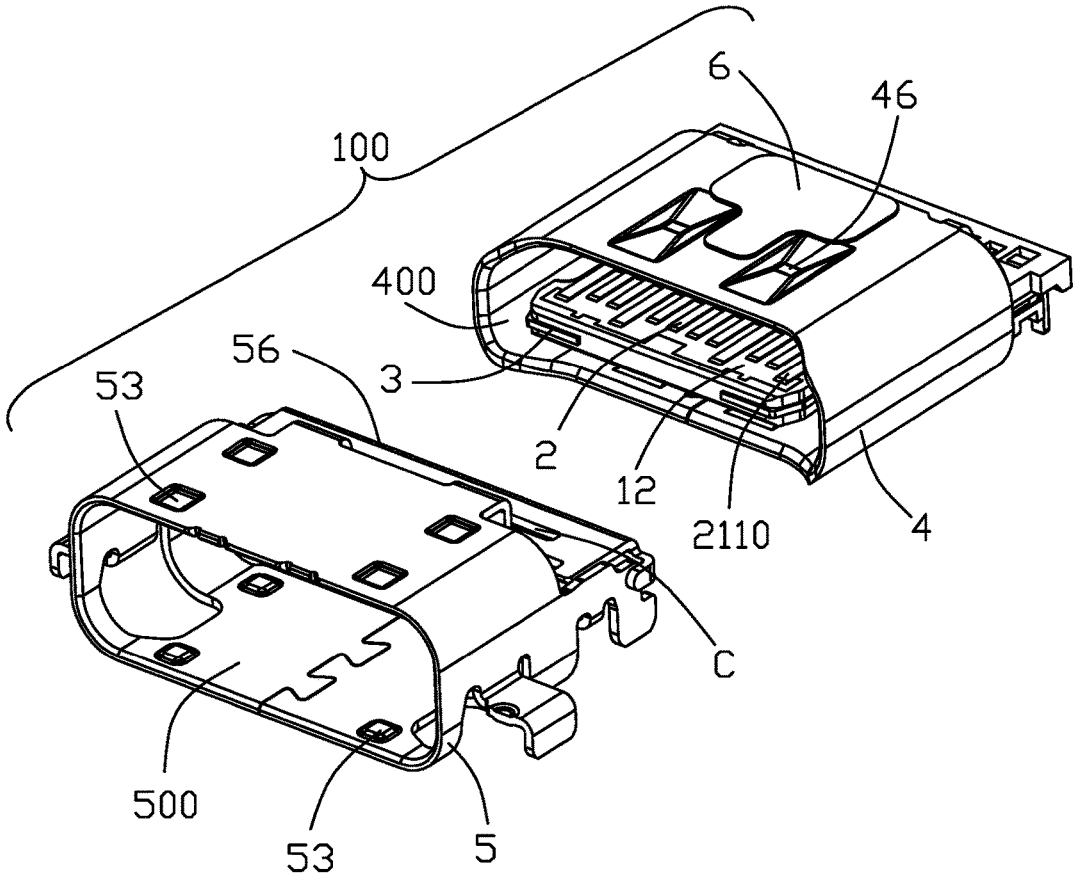
FIG. 4 is a perspective, partly exploded view of the electrical connector.
Figure 5:
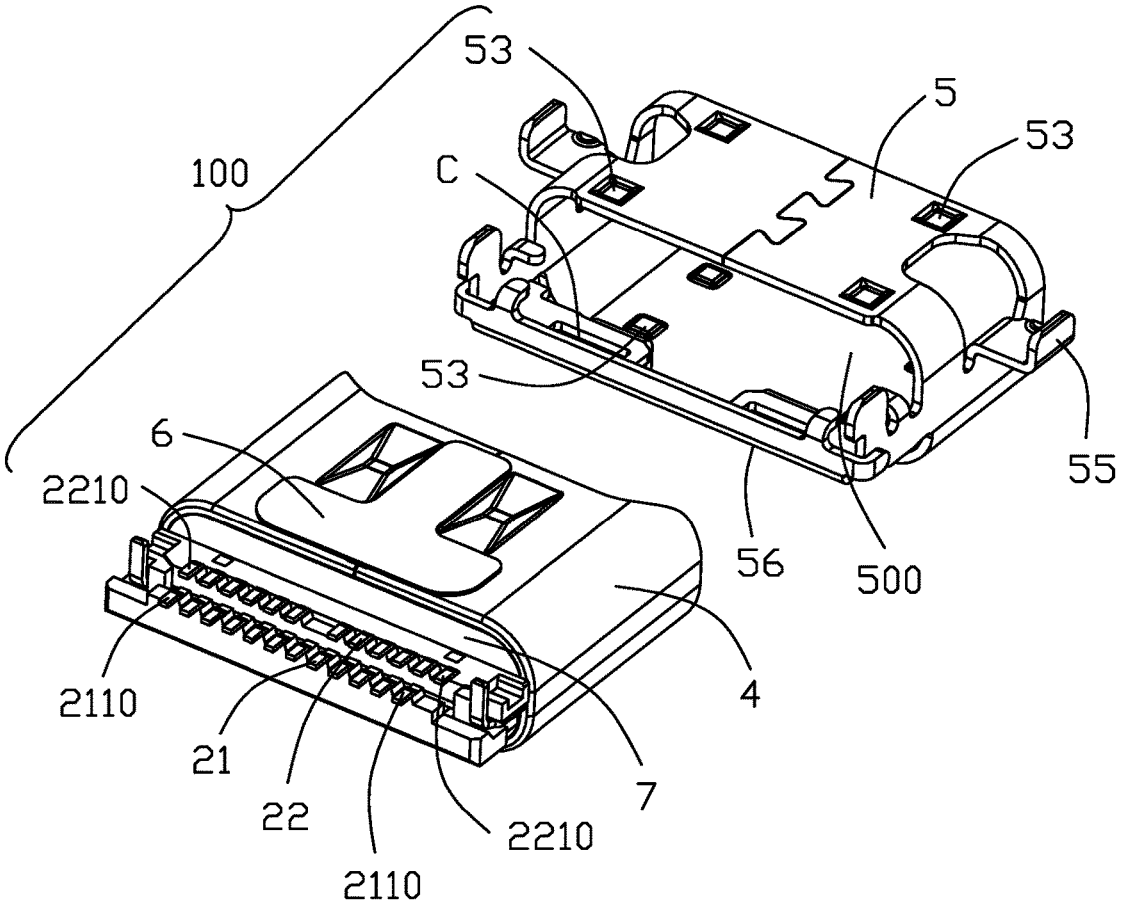
FIG. 5 is another perspective, exploded view of the electrical connector of FIG. 4.
Figure 6:
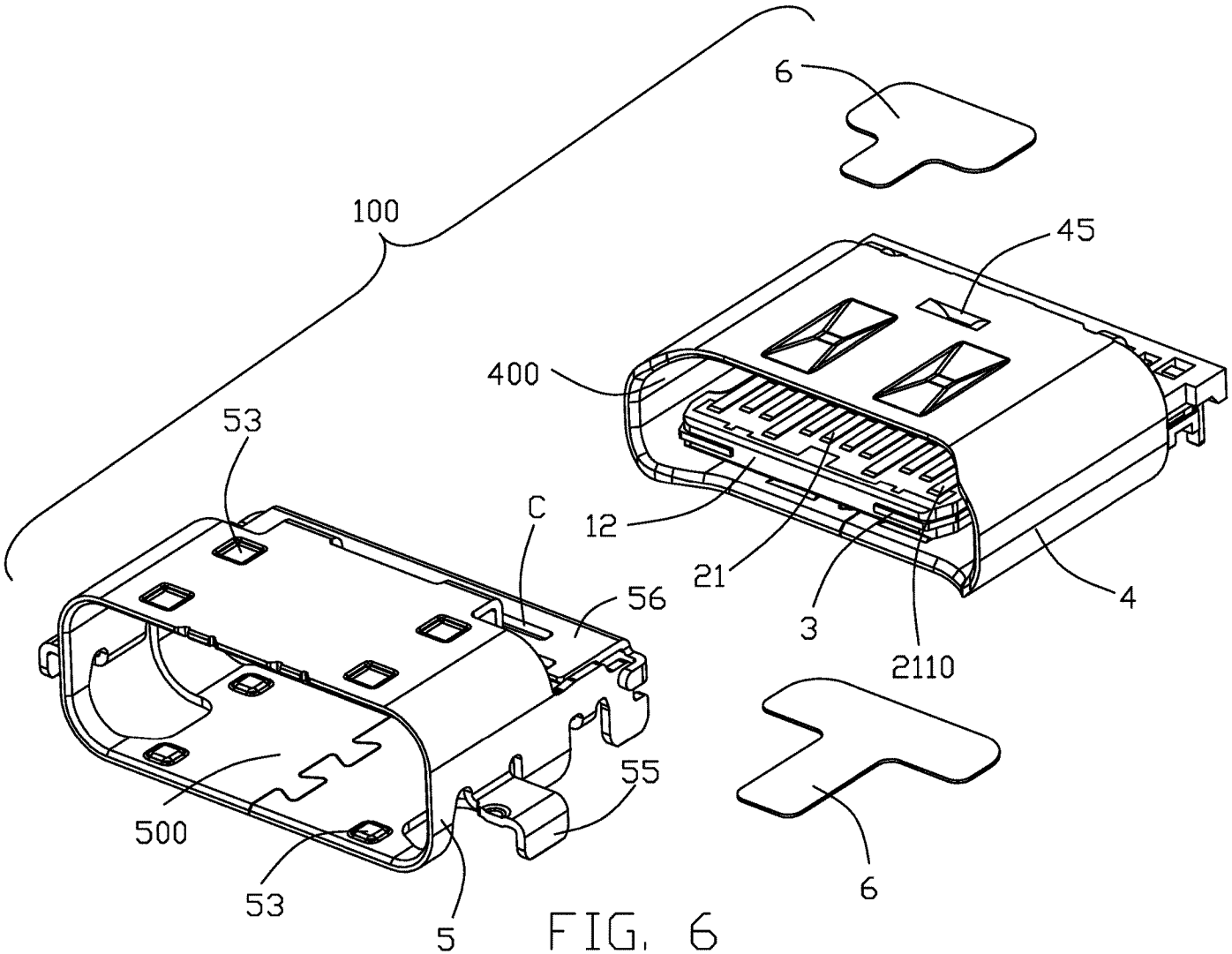
FIG. 6 is a further perspective, exploded view of FIG. 4.
Figure 7:
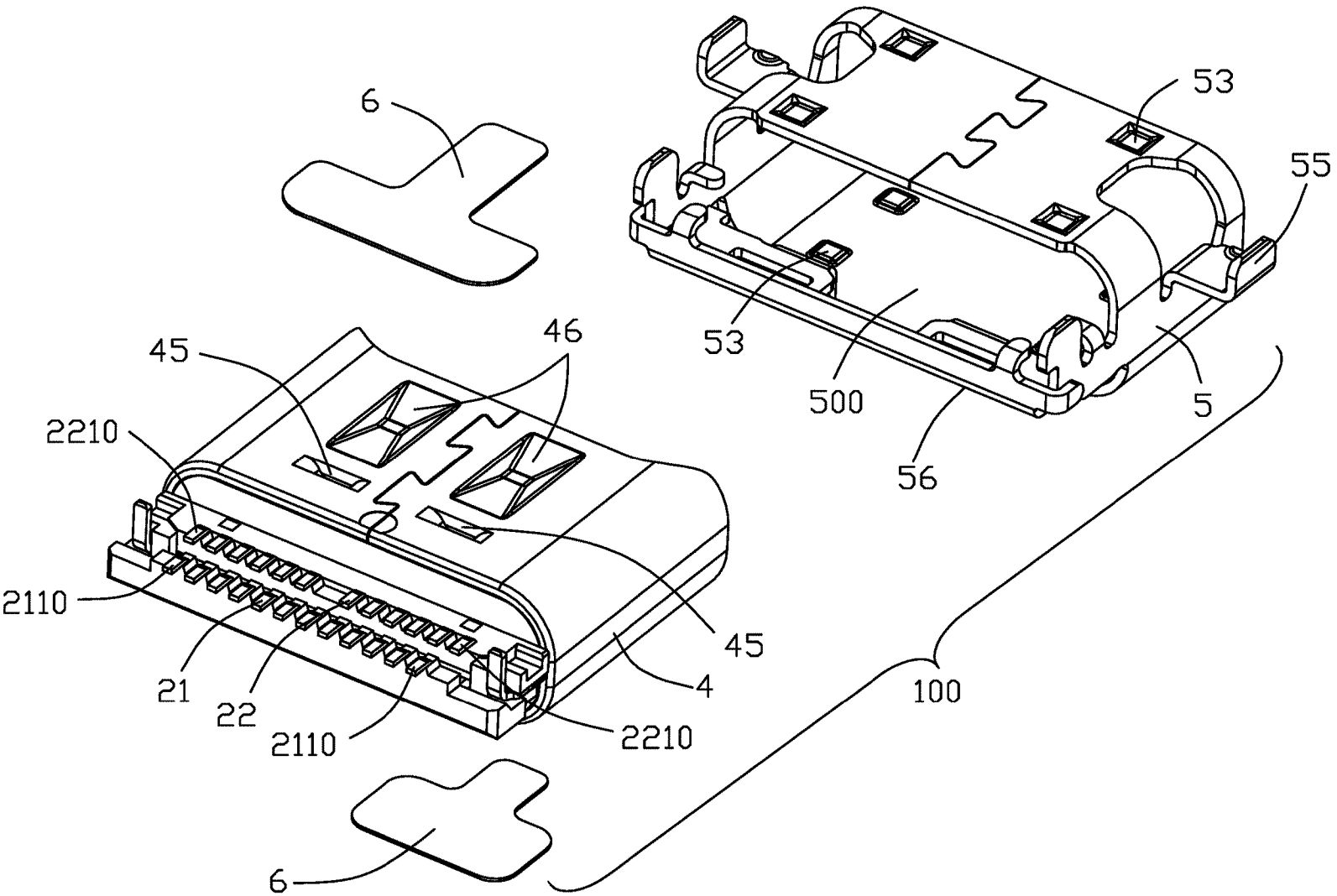
FIG. 7 is another perspective, exploded view of FIG. 6.
Figure 8:
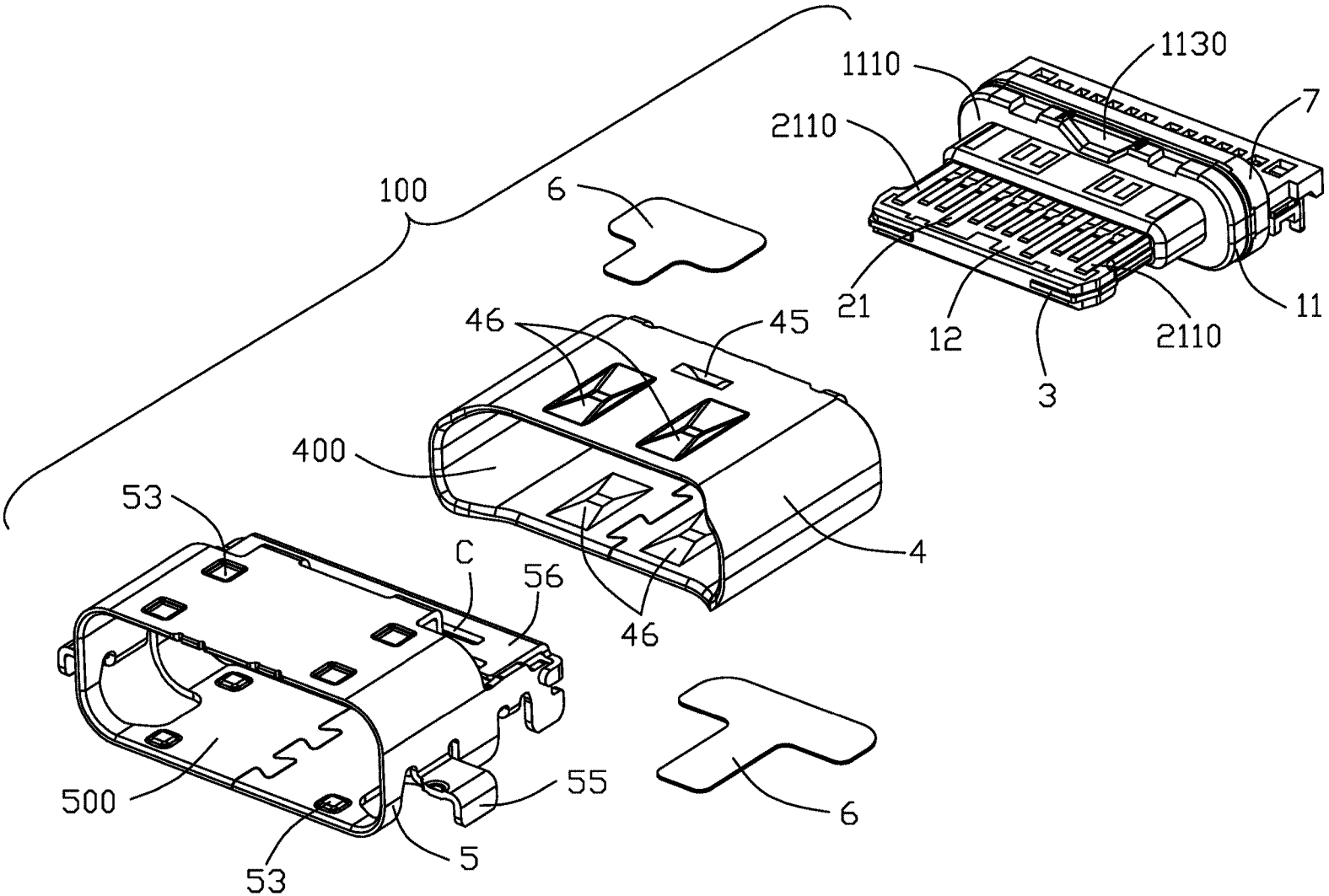
FIG. 8 is a further perspective, exploded view of FIG. 6.
Figure 9:
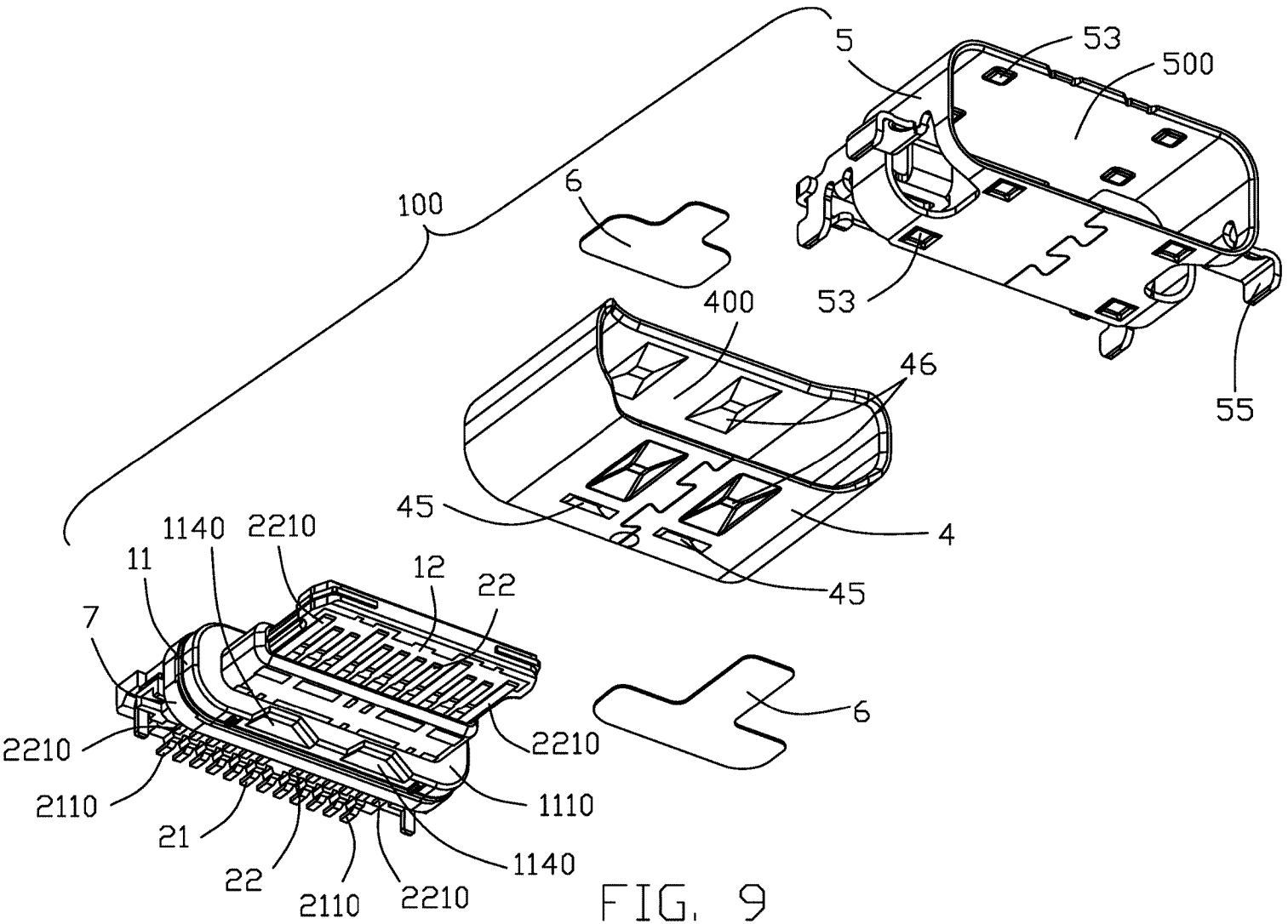
FIG. 9 is another perspective, exploded view of FIG. 8.
Figure 12A:
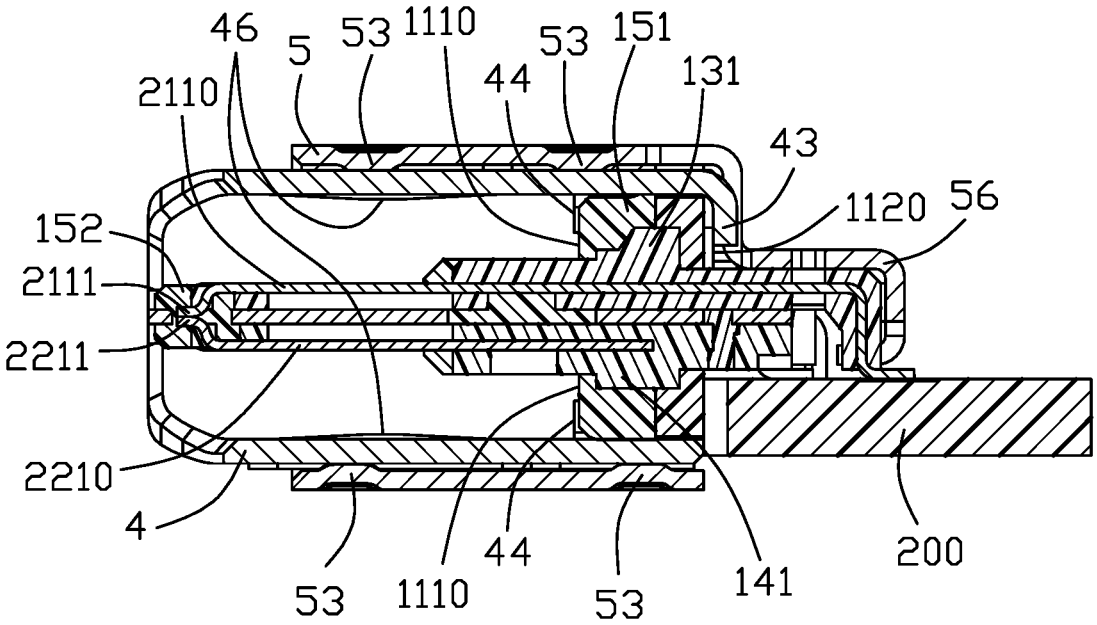
FIG. 12(A) is a cross-sectional view of the electrical connector along line 12A-12A in FIG. 1.
Figure 12B:
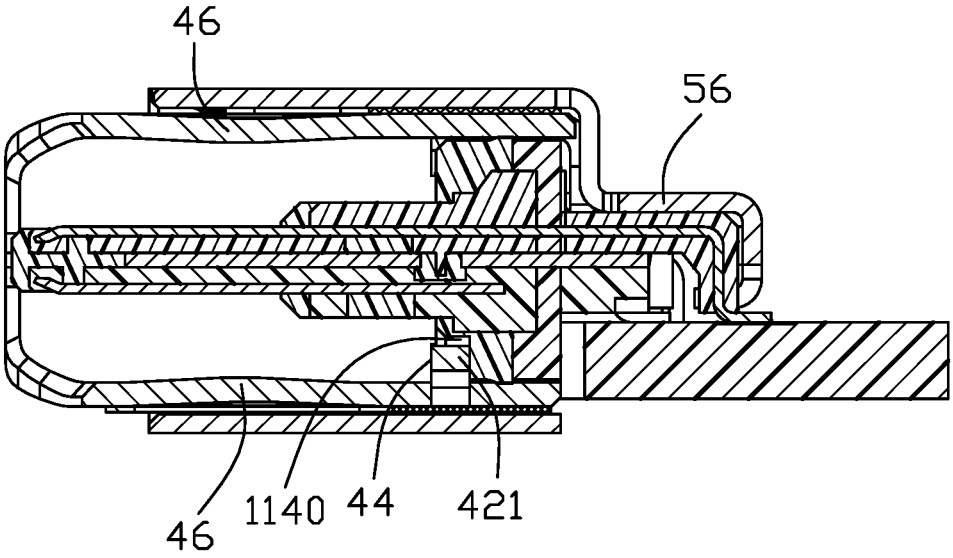
FIG. 12(B) is a cross-sectional view of the electrical connector along line 12B-12B in FIG. 1.
Figure 12C:
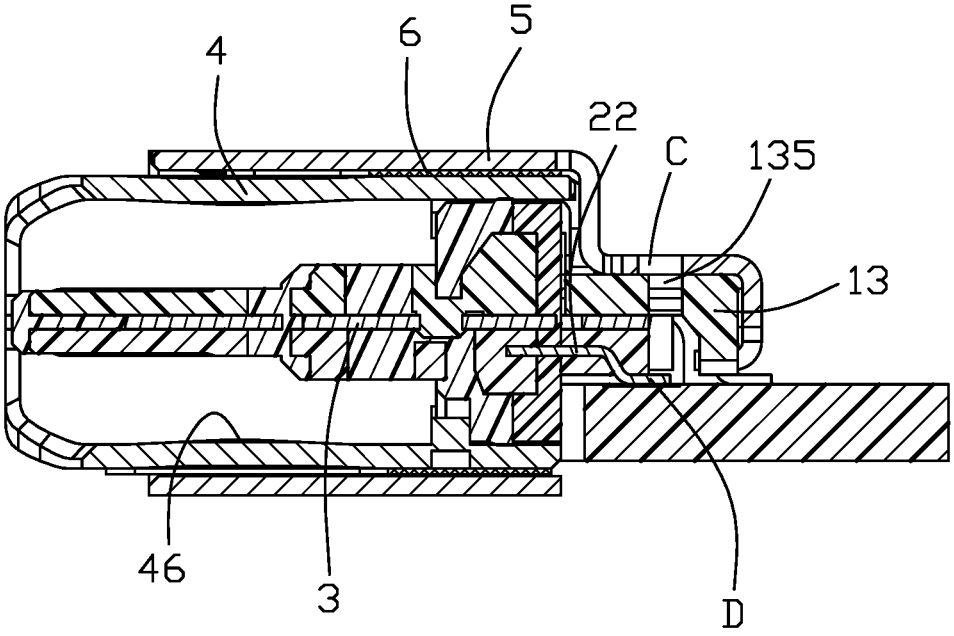
FIG. 12(C) is a cross-sectional view of the electrical connector along line 12C-12C in FIG. 1.

It is noted that the features of the invention is to have the stopping portion 411, 421 functions to not only stop the forward movement of the insulative body 13, 14 relative to the shielding shell 4 but also to stop the improper/excessive rearward movement of the mating plug connector (not shown) relative to the receptacle connector, thus efficiently preventing damage to the receptacle connector 100 due to excessive insertion of the plug connector, as shown in FIGS. 12(A) and 12(B). Moreover, the additional waterproof layers 6 are used to cover the openings 45 via which the stopping portions 411, 421 are formed wherein those waterproof layers 6 are configured not to be applied upon the protruding portions 53 of the metal shell 5 due to soldering thereof or even upon the protrusion portions 46 of the shielding shell 4. It is also noted that as already disclosed in the parent application Ser. No. 15/169,963, on one hand the shell 4 provides the rear stopping portion 43 to cooperate with the (front) upper stopping portion 411 and the (front) bottom stopping portion 421 to sandwich the housing 1 therebetween in a front-to-back direction so as to fasten the housing 1 and the shielding shell 4 together; on the other hand, the metal shell 5 is fastened to the shielding shell 4 via mechanical retention between the protruding portions 53 and the shielding shell 4, preferably via soldering in addition to clamping, and the metal shell 5 also abuts against the rear side 1120 of the base portion 11 of the housing 1 via either a vertical section A or a horizontal section B, as shown in FIG. 3. Notably, in FIGS. 3 and 12(C) the metal shell 5 includes the openings C cooperating/aligned with the through holes 135 of the first insulative body 13 in the vertical direction, may allow inspection of the tails D of the terminals 22 for assuring properness of surface-mounting thereof, as disclosed in the parent application. However, the disclosure is illustrative only, changes may be made in detail, especially in matter of shape, size, and arrangement of parts within the principles of the invention.

What is claimed is:

1. An electrical connector comprising:

an insulative housing defining a base portion and a tongue portion forwardly extending from the base portion in a front-to-back direction, the base portion defining a front side, a rear side opposite to the front side, and at least one retaining slot located in the front side;

a plurality of terminals disposed in the insulative housing;

a metallic shielding plate retained in the insulative housing; and a shielding shell enclosing the insulative housing to form a mating cavity receiving the base portion, the shielding shell defining at least one front stopping portion inwardly protruding into the mating cavity and received in the at least one retaining slot;

wherein the at least one front stopping portion has a front surface forwardly protruding out of the at least one retaining slot and forwardly extending beyond the front side of the base portion into the mating cavity.

2. The electrical connector as claimed in claim 1, wherein the terminals include a plurality of first terminals and a plurality of second terminals positioned to have 180 degree symmetry with the first terminals, each first terminal partly exposed to the upper surface of the tongue portion, each second terminal partly exposed to the bottom surface of the tongue portion, the first terminals including a pair of first grounding terminals located on opposite sides, the second terminals including a pair of second grounding terminals located on opposite sides and electrically connecting with the first grounding terminals respectively.

3. The electrical connector as claimed in claim 1, wherein the shielding shell further includes a pair of rear stopping portions located on a rear end thereof, each rear stopping portion engaged with the rear side of the base portion.

4. The electrical connector as claimed in claim 1, wherein the shielding shell defines an upper wall and a bottom wall opposite to the upper wall, the at least one front stopping portion includes at least one upper stopping portion located on the upper wall and at least one bottom stopping portion located on the bottom wall, and the upper stopping portion and the bottom stopping portion have a respective arc-shaped section from the upper wall and the bottom wall, an opening formed at the arc-shaped section on the upper wall and the bottom wall.

5. The electrical connector as claimed in claim 4, wherein the at least one retaining slot includes an upper retaining slot and a pair of bottom retaining slots, the upper retaining slot located at a middle position of an upper edge of the front side and the pair of bottom retaining slots located at a bottom edge of the front side, the pair of bottom retaining slots located on opposite sides of the upper retaining slot, the at least one upper stopping portion includes only one upper stopping portion cooperating with the upper retaining slot, and the at least one bottom stopping portion includes a pair of bottom stopping portions cooperating with the pair of bottom retaining slots respectively.

6. The electrical connector as claimed in claim 4, further comprising a plurality of waterproof plates attached to the upper wall and the bottom wall to close the opening.

7. The electrical connector as claimed in claim 6, further comprising a metal shell formed with a receiving cavity to receive the shielding shell, and wherein the metal shell includes an upper plate portion and a bottom plate portion each having a plurality of protruding portions protruding into the receiving cavity, and the protruding portion holds the shielding shell.

8. The electrical connector as claimed in claim 7, wherein each protruding portion is spaced from the waterproof plates.

9. The electrical connector as claimed in claim 8, wherein the protruding portions of the metal shell is soldered to the shielding shell.

10. The electrical connector as claimed in claim 8, wherein each of the upper plate portion and the bottom plate portion includes two rows of the protruding portions, and each row of the protruding portions is located on an outer side of the waterproof plate in a transverse direction perpendicular to the front-to-back direction.

11. An electrical connector comprising:

an insulative housing including a base portion and a tongue portion extending forwardly from the base portion;

a plurality of upper terminals disposed in the housing with contacting sections exposed upon an upper surface of the tongue portion;

a plurality of lower terminals disposed in the housing with contacting sections exposed upon a lower surface of the tongue portion;

a tubular metallic shielding shell enclosing the insulative housing and defining a mating cavity in which said tongue portion extends, said shielding shell further forming at least a front stopping portion to prevent forward movement of the housing relative to the shielding shell, and a rear stopping portion to prevent rearward movement of the housing relative to the shielding shell;

a tubular metal shell enclosing said shielding shell and including an extension covering a rear side of the base portion, and a plurality of protruding portions inwardly and vertically abutting against and soldered to the shielding shell for securing the metal shell and said shielding shell together.

12. The electrical connector as claimed in claim 11, wherein said metal shell further includes mounting legs for mounting to a printed circuit board while said shielding shell lacks mounting legs.

13. The electrical connector as claimed in claim 11, wherein said front stopping portion is stamped from the shielding metal and received within a corresponding recess of the base portion.

14. The electrical connector as claimed in claim 13, further including a waterproof layer sandwiched between the shielding shell and the metal shell to cover an opening formed around the front stopping portion due to stamping, while said waterproof layer extends transversely not to reach the protruding portions.

15. The electrical connector as claimed in claim 14, wherein said shielding shell further includes a plurality of curved portions inwardly extending into the mating cavity in a vertical direction for mating with a plug connector, and said waterproof layer extend transversely not to reach the curved portions.

16. The electrical connector as claimed in claim 11, wherein said base portion forms a plurality of through holes to cooperate with at least an opening in the extension of the metal shell for allowing downwardly inspecting tails of the lower terminals in a vertical direction.

17. An electrical connector comprising an insulative housing including a base portion and a tongue portion extending forwardly from the base portion;

a plurality of upper terminals disposed in the housing with contacting sections exposed upon an upper surface of the tongue portion;

a plurality of lower terminals disposed in the housing with contacting sections exposed upon a lower surface of the tongue portion;

a tubular metallic shielding shell enclosing the insulative housing and defining a mating cavity in which said tongue portion extends, said shielding shell further forming at least a front stopping portion to prevent forward movement of the housing relative to the shielding shell; and a tubular metal shell enclosing said shielding shell and including an extension covering a rear side of the base portion, and a plurality of protruding portions inwardly and vertically abutting against and soldered to the shielding shell for securing the metal shell and said shielding shell together; wherein said base portion forms a plurality of through holes to cooperate with at least an opening in the extension of the metal shell for allowing downwardly inspecting tails of the lower terminals in a vertical direction.

18. The electrical connector as claimed in claim 17, wherein said shielding shell further includes a plurality of curved portions inwardly extending into the mating cavity in a vertical direction for mating with a plug connector, and no opening is formed around each of said curved portions in the shielding shell.

19. The electrical connector as claimed in claim 17, wherein said front stopping portion includes a forward abutment surface located in front of the base portion for confronting a plug connector inserted into the mating cavity.

20. The electrical connector as claimed in claim 19, wherein said front stopping portion is unitarily split from the shielding shell with an opening thereabouts, and a waterproof layer is located between the shielding shell and the metal shell to cover said opening in a vertical direction.

* * * * *